US006286826B1

(12) United States Patent
Hummel et al.

(10) Patent No.: US 6,286,826 B1
(45) Date of Patent: Sep. 11, 2001

(54) STACK CHANGING DEVICE

(75) Inventors: Peter Hummel, Offenbach; Robert Ortner, Alzenau; Jens Gebel, Seligenstadt; Marc Hinz, Rodenbach; Bernd Ullrich, Kahl/Main; Uwe Basel, Offenbach; Harald Wolski, Rodgau, all of (DE)

(73) Assignee: MAN Roland Druckmaschinen AG (DE)

( * ) Notice: Subject to any disclaimer, the term of this patent is extended or adjusted under 35 U.S.C. 154(b) by 0 days.

(21) Appl. No.: 09/355,885

(22) PCT Filed: Feb. 3, 1998

(86) PCT No.: PCT/EP98/00562

§ 371 Date: Aug. 4, 1999

§ 102(e) Date: Aug. 4, 1999

(87) PCT Pub. No.: WO98/34861

PCT Pub. Date: Aug. 13, 1998

(30) Foreign Application Priority Data

Feb. 5, 1997 (DE) ..... 197 04 285

(51) Int. Cl.[7] ..... B65H 1/00; B65H 1/08; B65H 1/30

(52) U.S. Cl. ..... 271/159

(58) Field of Search ..... 271/157, 158, 271/159

(56) References Cited

U.S. PATENT DOCUMENTS 3,951,401 * 4/1976 Marass ..... 271/158
3,975,011 * 8/1976 Marass ..... 271/157
5,096,372 * 3/1992 Maejima ..... 414/796.7 X
5,303,911 * 4/1994 Zahn et al. ..... 271/158
5,335,903 * 8/1994 Martin et al. ..... 271/157
5,529,456 * 6/1996 Luxem et al. ..... 414/795.8 X
5,538,238 * 7/1996 Filsinger ..... 271/159
5,803,446 * 9/1998 Luthold et al. ..... 271/9.08 X
6,000,691 * 12/1999 Chmelar ..... 271/158
6,142,463 * 11/2000 Leichnitz et al. ..... 271/159

FOREIGN PATENT DOCUMENTS 39 31 710 A 4/1990 (DE) .
42 03 500 A 8/1993 (DE) .

* cited by examiner

*Primary Examiner*—Christopher P. Ellis
*Assistant Examiner*—Kenneth W. Bower
(74) *Attorney, Agent, or Firm*—Leydig, Voit & Mayer, Ltd.

(57) ABSTRACT

In a non-stop stack changing device, remaining-stack bars are pulled from the stack area one by one and out-of-line in relation to each other. To this end, a pull/push drive is provided, which makes it possible to push the remaining-stack bars simultaneously into the grooves of a pallet carrying a sheet stack. Furthermore, the pull/push drive makes it possible to pull the remaining-stack bars in pairs from inside outwards out of the stack area. In addition, the remaining-stack bars can be pulled in a first and second sequence in accordance with this model. An individual motor drive is provided for this purpose, which operates interlockingly on each individual remaining-stack bar.

7 Claims, 6 Drawing Sheets

STACK CHANGING DEVICE

FIELD OF THE INVENTION

The present invention relates to sheet-fed printing machines and, more particularly to an improved stack changing device for sheet feeders of sheet-fed printing machines.

BACKGROUND OF THE INVENTION

It is a known practice in sheet feeders of sheet printing machines or other sheet processing machines to provide arrangements for automated stack changing. These may consist of rack-type structures, so-called remaining-stack carrying devices, which are provided with pushing and lifting drives for horizontal and vertical movements. Such so-called non-stop stack changers are suited, for example during the printing of paper sheets, i.e. with the machine running, to take over remainders of worked-out sheet stacks from, for example, a pallet provided with grooves and to deposit them again onto a new sheet stack subsequently installed in the sheet feeder. Known devices are distinguished by high construction and assembly expenditures and require special constructions of the sheet feeders. Further, devices are used the remaining-stack carrying device of which has a rack engaging into the grooves of the pallet. This rack is to be removed when the remaining stack is combined with the newly installed sheet stack to form a single whole stack from the two stack parts. This involves high drive forces and puts a very severe strain on the sheets lying closest to the cut point. Furthermore, retaining means are provided which prevent a shifting of the stack parts and in the process a severely strain the stack edges. Furthermore, the operation of the sheet feeder itself is severely hampered or even rendered impossible. The sheet running during the changing process is difficult to control, so that again and again waste sheets result. Devices have been developed already, however, which partly avoid some of the disadvantages described.

Thus from DE 32931710 C2 there is known a non-stop sheet feeder for sheet rotary machines. It has a remaining-stack carrying device which is arranged underneath a conveyor table leading from the sheet feeder to the sheet rotary machine. The remaining-stack carrying device has a closed frame on which there are arranged non-stop bars which are driven as piston rods of individual cylinder by means of a pressure medium and which are drivable into grooves of a pallet carrying a sheet stack. The non-stop rods in the driven-in state lie on both sides of the frame and are removed in succession from the range of the sheet feeder. Nothing is said, about the operating sequence. The control of the non-stop bars is very involved and not directly adaptable to the requirements of the stack changing.

From DE 4203500 Al a sheet feeder is known. It presents, parallel to the sheet feeder and allocated to this on the face side, a remaining-stack carrying device as independent component. Therein, individually drivable pointed bars are provided which are drivable over a common drive into grooves of a pallet carrying a sheet stack. The drive has individual chain drives that are coupleable to the respective pointed bars. For the guidance and accessibility of the chain drives, special constructive measures are required. The chain drives are constantly spanned under a frame of their own and completely block the space in front of the sheet feeder, so that the latter is not accessible. In the stack changing, the pointed bars out of the stack zone can be removed, in the combining of main and remaining stacks, first on the outside, then in the middle and lastly in the zone between the already pulled pointed bars, so that there is supposed to be a gentle depositing of the remaining stack on the sheet stack. For this it is necessary to couple the chain drives in an expensive manner onto the pointed bars, in which operation the drive of the pointed bars can occur only in common.

OBJECTS AND SUMMARY OF THE INVENTION

In view of the foregoing, an object of the present invention is to provide an improved stack changing device which overcomes the problems associated with prior art designs.

A more specific object of the present invention is to provide a stack changing device which allows for simple and continuous stack changing through the use of a drive that is optimally adapted to the desired stack changing conditions.

The present invention provides these and other advantages and overcomes the drawbacks of the prior art by providing a stack changing device with an improved drive for moving the remaining-stack carrying bars.

It is advantageous that remaining-stack bars are provided which are movable independently from one another are provided in the device, and which are drawn, intermittently, out of the stacking zone. The simple and compact drive proposed for this purpose makes possible the space-saving arrangement of the remaining-stack carrying device. A differing height of the remaining-stack bars generates a smooth depositing movement of the remaining stack on the sheet stack. The continuous removal of the remaining-stack bars from the inside, outward and in two stages makes possible a gentle depositing of the remaining stack onto the sheet stack. As the remaining-stack bars are made of differing length, there results an improved working run-off. Further improvements are brought by a staggering of the speed of the individual remaining-stack bars to one another.

These and other features and advantages of the invention will be more readily apparent upon reading the following description of preferred exemplary embodiments of the invention and upon reference to the drawings wherein:

While the invention will be described and disclosed in connection with certain preferred embodiments and procedures, it is not intended to limit the invention to those embodiments. Rather it is intended to cover all such alternative embodiments and modifications as fall within the spirit and scope of the invention.

DETAILED DESCRIPTION OF THE PREFERRED EMBODIMENTS

Figure 1:
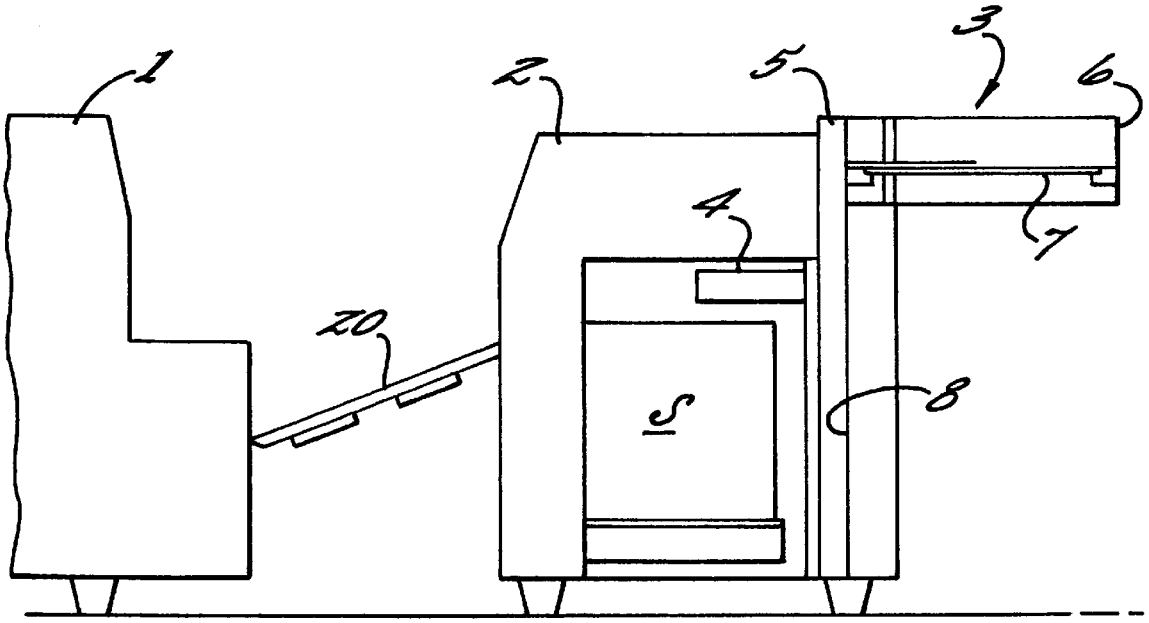
FIG. 1 is a side elevation view of an illustrative embodiment of a sheet feeder constructed in accordance with the present invention

In FIG. 1 there is shown a sheet feeder 2 connected with a sheet processing machine, for example with a sheet printing machine 1. In the sheet feeder 2 there is installed a sheet stack S for processing. The sheet stack S can be lifted in the rhythm of the sheet processing, by means of a main stack lifting mechanism that is not shown in detail here. The sheets of the sheet stack S are singled and fed to the sheet printing machine 1 in a sheet stream. In the sheet feeder 2, for this purpose, there is provided a sheet singling arrangement 4 which is provided with a full number of manifold operating elements for format-dependent adjustments and for adjustments to the supplying of suction or blast air. The operating elements serve for the attuning of the various functions of the sheet singling device 3 which is for the proper transport of the sheets from the sheet feeder 2 to the sheet printing machine 1. In the sheet feeder 2 there is further arranged a remaining-stack carrying device 3, which is assigned to the face side of the sheet feeder 2 facing away from the sheet printing machine 1. The remaining-stack carrying device 3 is provided with a frame 6 in which there are borne remaining stack bars 7 slidable longitudinally. By means of the frame 6, the remaining-stack carrying device 3 is suspended in vertical guide rails 8 on a remaining-stack lifting mechanism 5, which is here merely shown. The remaining-stack lifting mechanism 5 can lift onto the remaining-stack carrying device 3 a remaining stack H in the rhythm of the sheet processing, and it is controllable synchronously with the main-stack lifting mechanism.

Figure 2:
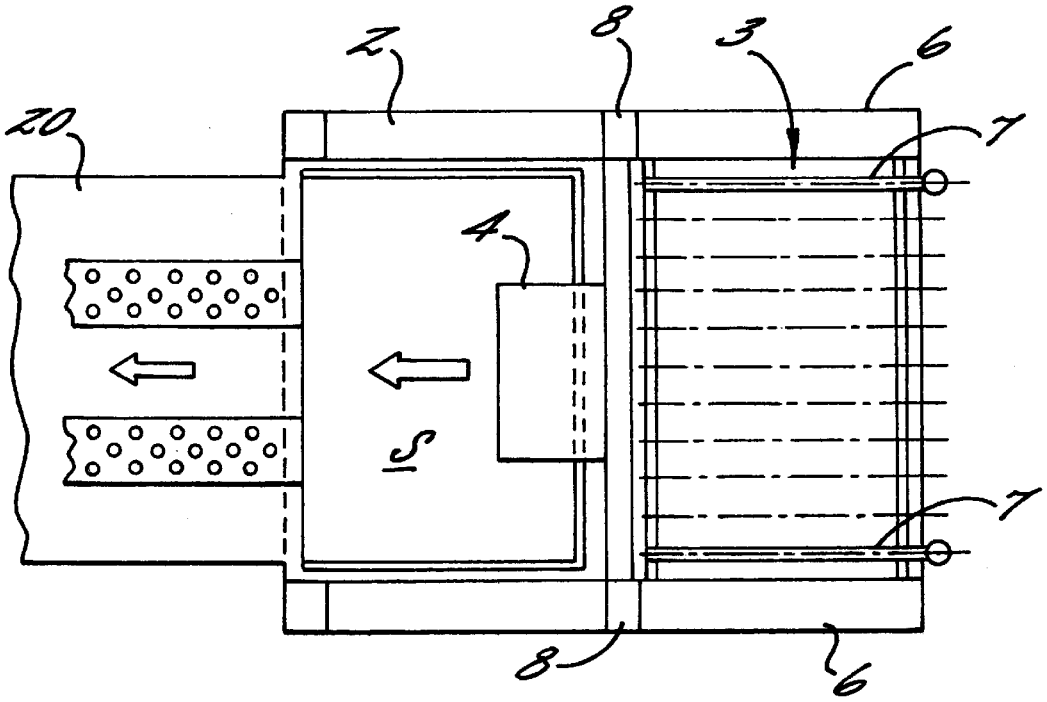
FIG. 2 is a plan view of a sheet feeder.

In FIG. 2 the sheet feeder 2 is shown in a top view. Following on the sheet feeder 2, in the sheet running direction, indicated by arrows, there is a so-called conveyor table 20, over which the sheet stream generated by the singling is transported to the sheet processing mechanism of the printing machine. Further, the position of the sheet singling device 4 allocated to the rear edge of the sheet stack S is shown. The orientation of the remaining-stack bars 7 is represented in their arrangement with respect to the sheet feeder 2, in which only the two outer remaining-stack bars 7 are represented, and the others are indicated with broken lines. The position shown is the waiting position, outside of the operating range of the sheet feeder 2. The remaining-stack bars 7 are guided within the remaining-stack carrying device 3, so that they occupy a horizontal position. The remaining-stack carrying device 3 with its frame 6 is guided by means of the guide rails 8 in the sheet feeder 2, and it is vertically movable. The remaining-stack lifting mechanism 5 is located on the upper side of the guide rails 8 and engages, from there on the frame 6 of the remaining-stack carrying device 3, and moves this device up and down on the guide rails 8.

From FIG. 1 it is to be seen that the remaining-stack carrying device 3 is attached by means of the guide rails 8 directly on the sheet feeder 2 and can be lifted over the entire height of the sheet singling device 4. The remaining-stack lifting mechanism 5 is raisable and lowerable during the supplying with sheets of a sheet processing machine, for example the printing machine 1, and the remaining-stack carrying device 3 is movable outside of the processing zone for the stack change proper. Through this arrangement in the sheet feeder 2, the sheet feeder is very accessible from its face-side operating side.

Figure 3:
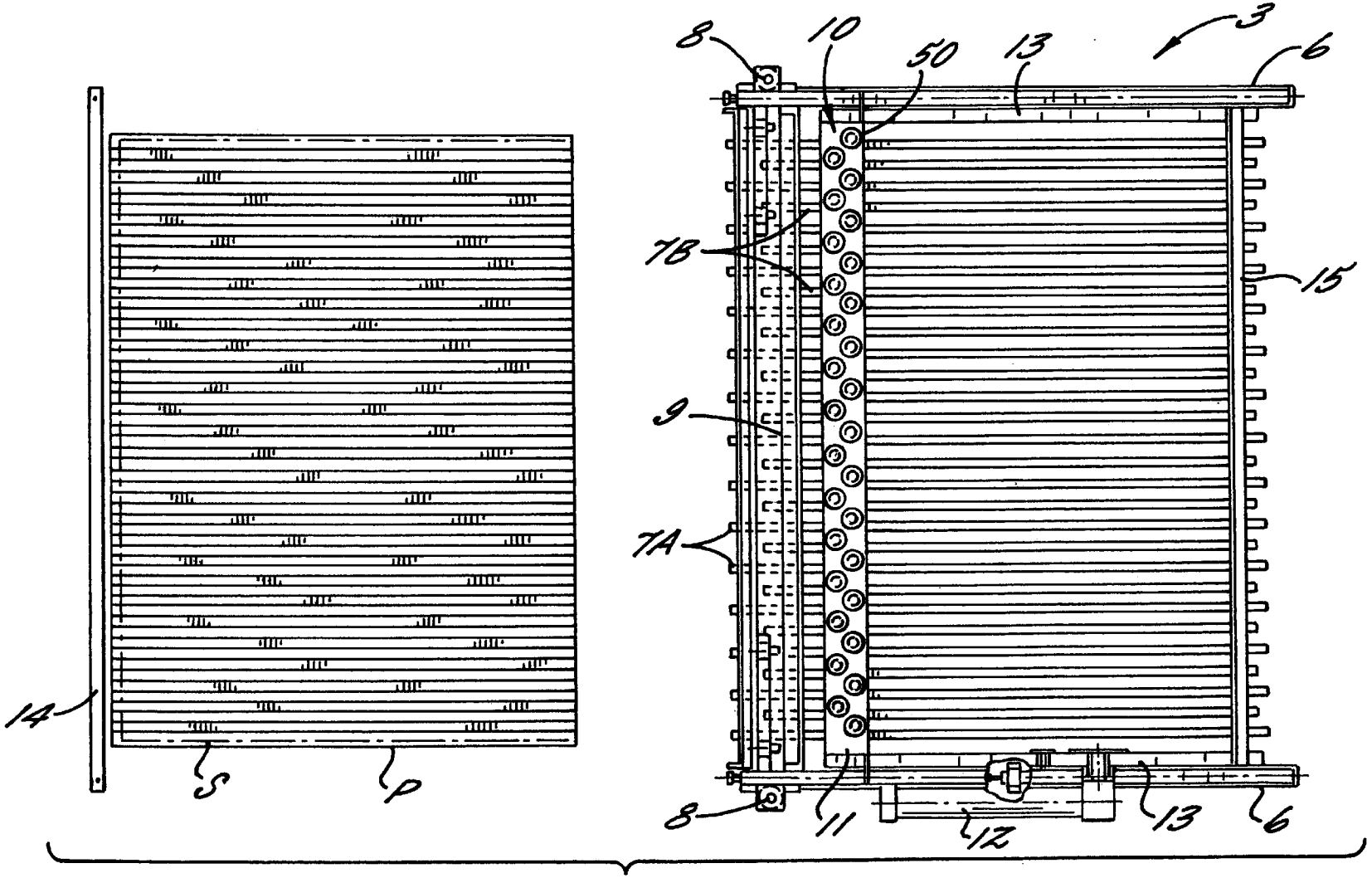
FIG. 3 is a plan view of a remaining-stack carrying device.
Figure 8:
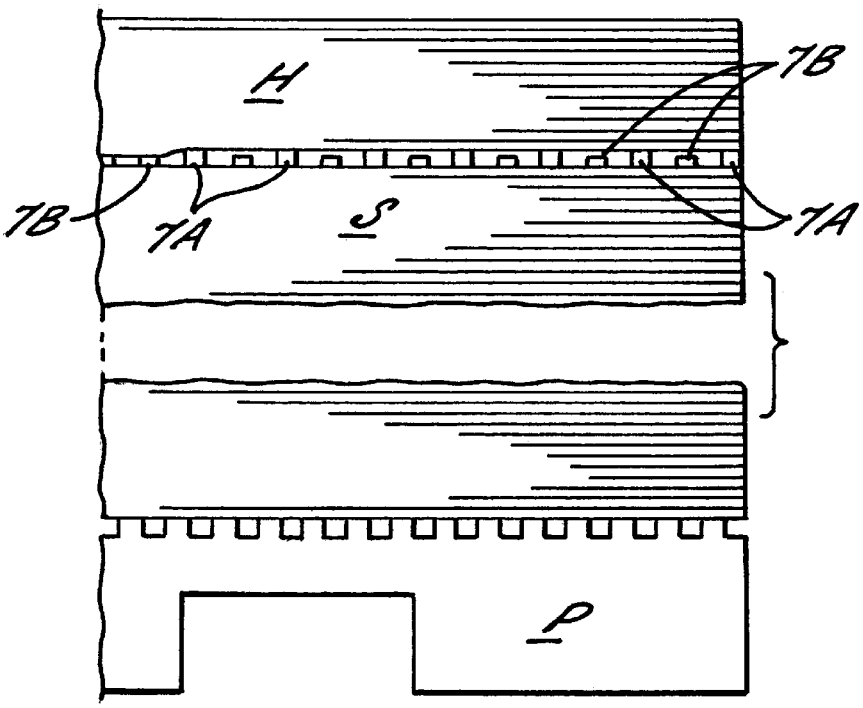
FIG. 8 is a schematic side elevation view showing the carrying bars and spacing bars disposed between the remaining stack and the new sheet stack.

In FIG. 3 there is shown a complete representation of the remaining-stack carrying device 3. The frame 6 is vertically guided on the guide rails 8. In the frame 6, in a front carrying rail 9, the remaining-stack bars are guided in the form of carrying bars 7A and spacing bars 7B. On a rear carrying rail 10, a pull drive 11 is arranged for the singled drawing out of the carrying bars 7A and spacing bars 7B. The position shown is the waiting position. Further, drives 12 are provided on both sides for the lengthwise shifting of the rear carrying rail 10 on guide rails 1 on the frame 6. The drives 12 determine the position of the rear carrying rail 10 on the rear end of, or inside, the frame 6. The front carrying rail 9 is firmly joined with the frame 6. The carrying bars 7A and spacing bars 7B are of different height as shown in FIG. 8. The carrying bars 7A are, for example, about twice as high as the spacing bars 7B. By height there is meant the extension of the carrying bars 7A or spacing bars 7B perpendicularly to the extended plane of the remaining-stack carrying device 3. The effect of this measure will still be shown thoroughly in the following representations.

The carrying bars 7A and spacing bars 7B can be of equal length. In a preferred form of execution the carrying bars 7A, however, are longer than the spacing bars 7B. The carrying bars 7A serve in the taking-over of a remaining stack H, first of all for the load reception and are to be dimensioned correspondingly, in which system the load is to be led off into a further carrying means (see FIG. 4).

Figure 4:
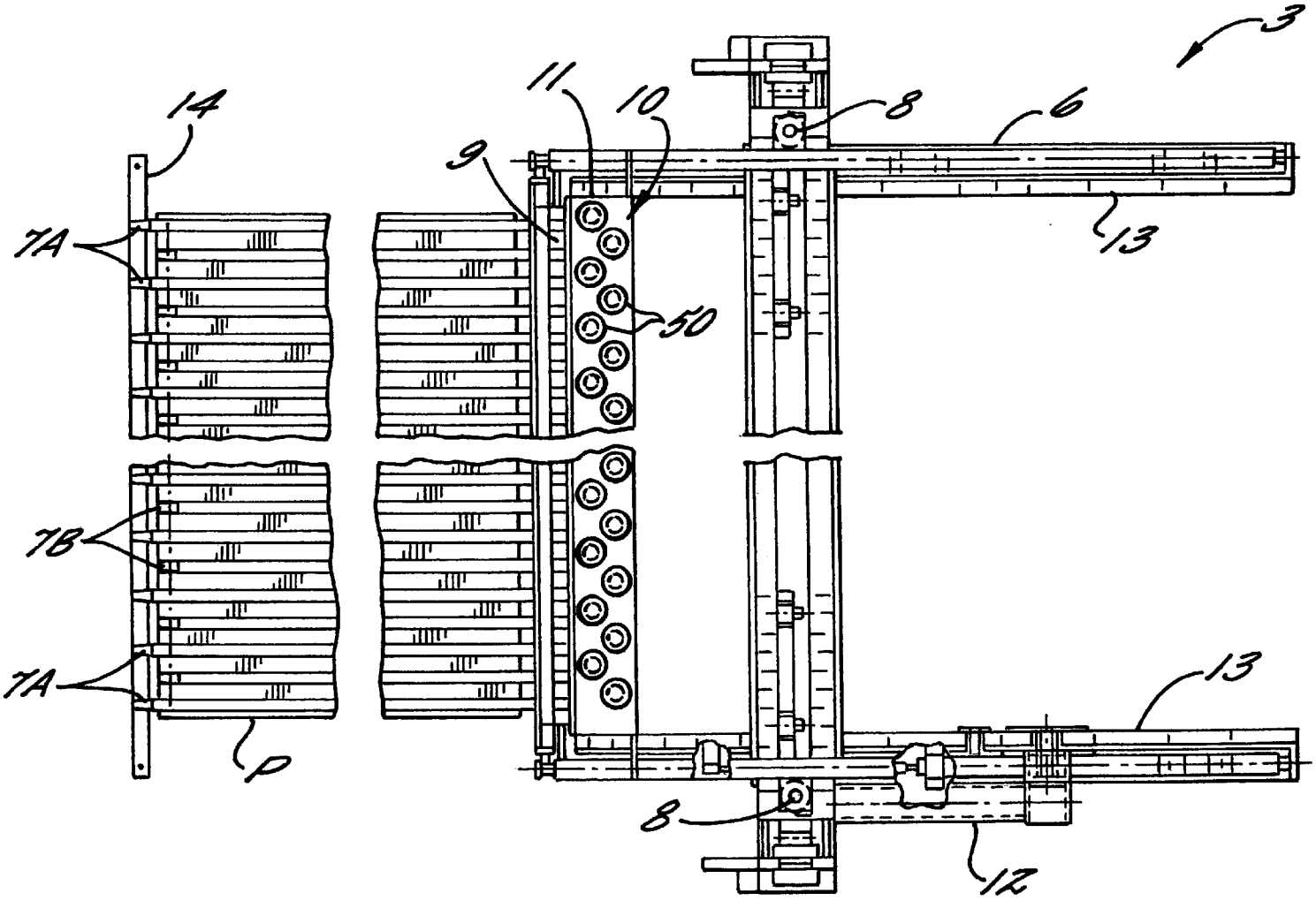
FIG. 4 is a plan view showing the remaining stack carrying device of FIG. 3 taking over of a remaining stack.

In FIG. 4, the remaining-stack carrying device 3 is shown in operation. The carrying bars 7A, as well as the spacing bars 7B, are thrust forward together with the rear carrying rail 10 with respect to the front carrying rail 9 and introduced into grooves of a pallet P carrying the sheet stack S. Front carrying rail 9 and rear carrying rail 10 with the pull drive 11 now lie parallel in front of the pallet P which carries a remainder of a sheet stack S, the so-called remaining stack H. The pallet P and the remaining stack H are not touched there by the front carrying rail 9. The longer and higher carrying bars 7A lie on a remaining-stack lifting rail 14 on the front end in the sheet feeder 2, as seen in sheet running direction. This remaining-stack lifting rail 14 is coupled with a lifting drive and is provided for the support of the carrying bars 7A, as well as for their lifting movement during production. The remaining-stack lifting rail 14 and the remaining-stack lifting mechanism 5 are both connected for this purpose with the stack lifting device of the sheet feeder 2 or at least mechanically or controllably coupled with one another so that in the stack processing, and especially, however, in the bringing-together of the remaining stack H with a new sheet stack S, they can be synchronously lifted.

From FIG. 4 it is shown that in the position represented of the remaining-stack carrying device 3, with carrying bars 7A and spacing bars 7B thrust into the grooves of the pallet P, the space inside of the frame 6 is free and the frame 6 is open to the rear.

Figure 5:
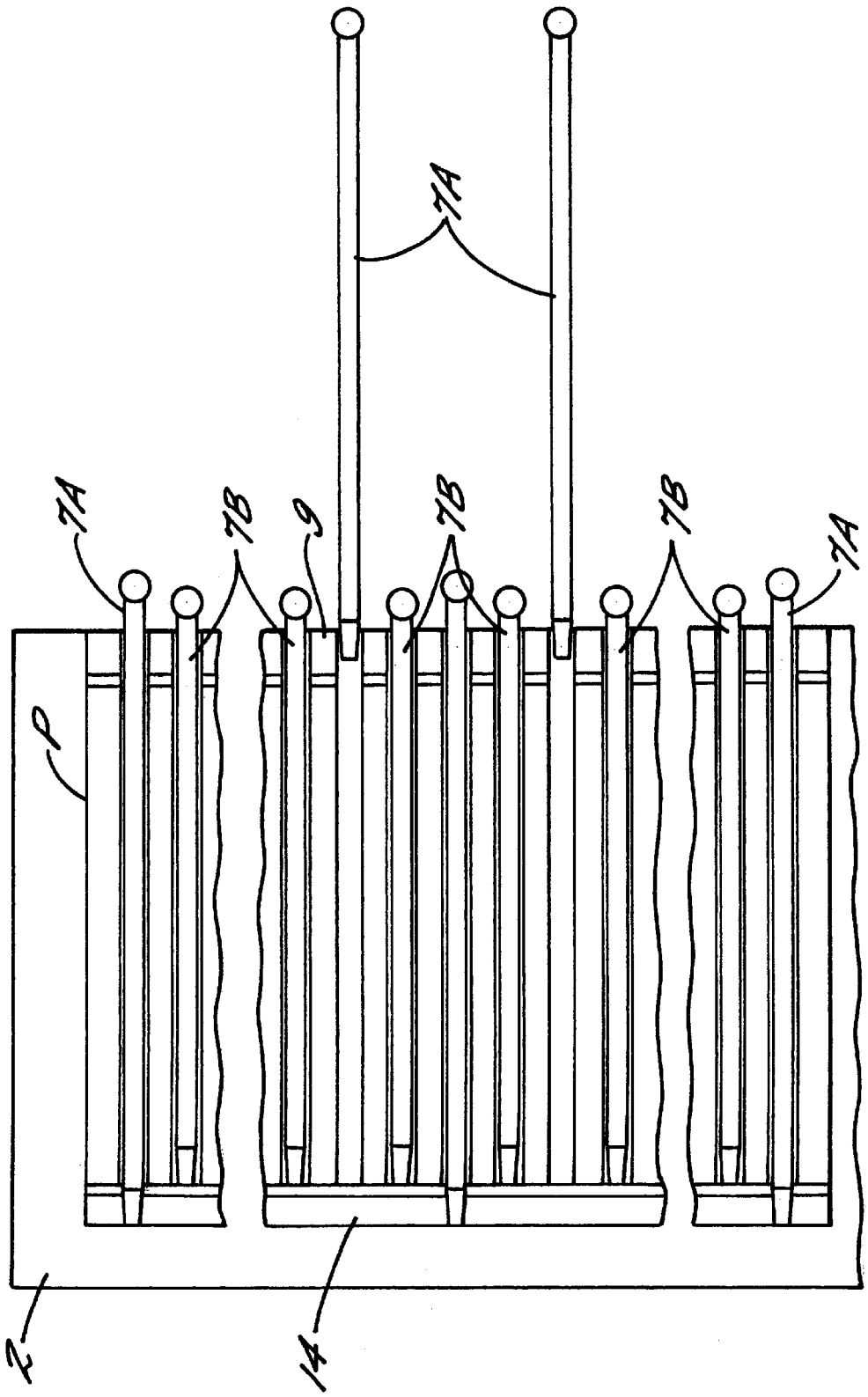
FIG. 5 is a plan view showing the stack changing device during the stack changing.

In FIG. 5, the relation of the pulling movement to the arrangement is once again clarified within the sheet feeder 2. The carrying bars 7A and the spacing bars 7B lie alternately in grooves of a pallet P (in which context one has to imagine oneself as lying on the crosspieces between the grooves of the pallet P, perpendicular to the sheet stack S). The carrying bars 7A lie there on the remaining-stack lifting rail 14. The same holds in the illustrated case for the inner spacing bars 7B, which have only half the height of the carrying bars 7A. The pulling process of the carrying bars 7A begins with the thicker carrying bars 7A lying next to the stack middle, which are, as shown, pulled as a pair. There the remaining stack H in this zone comes to lie continuously on the thinner spacing bars 7B. The pulling of the thicker carrying bars 7A and, consequently of the thinner spacing bars 7B occurs smoothly and in close time sequence, but always separately from one another. For this a device is provided for controlling the pulling movement.

The stacking changing, therefore, proceeds as follows:

I—On reaching a minimum height of the sheet stack S, the stack changing process is started.

II—The carrying bars 7A and the spacing bars 7B are thrust in common from the frame 6 into the grooves of the pallet P underneath the sheet S, the sheet stack S remaining free on the rear side toward the remaining-stack carrying device 3.

III—The remaining stack passes under the carrying bars 7A and the lifting rail lifts it until the remaining stack H is carried by the carrying bars 7A.

IV.—The pallet P is lowered and removed from the sheet feeder 2.

V.—The remaining-stack H is further raised continuously by means of the stack-lifting drive, for the singling of the sheets.

VI.—A new sheet stack S is installed in the sheet feeder 2 and lifted by means of the main stack lift.

VII.—On contacting of the upper side of the sheet stack S with the underside of the carrying bars 7A, the pulling process of the carrying bars 7A is initiated.

VIII.—The carrying bars 7A are extracted singly or in pairs from the inside outward, between the remaining stack H and the sheet stack S.

IX.—The remaining stack H comes to lie continuously from inside, outward on the spacing bars 7B.

X.—The remaining-stack lifting rail becomes free, the remaining stack carrying device 3 does not take on any more load, the remaining spacing bars 7B still have only a control function for the stack unification.

XI.—The spacing bars 7B are continuously extracted from inside, outward between the remaining stack H and the sheet stack S.

XII.—The remaining stack H comes to lie continuously from inside outward on the upper side of the sheet stack S.

In a further embodiment all of the remaining-stack carrying bars 7 are not used. Thus, in the case of very thick sheet materials, which as a result of their stability sink only slowly into the increasing intermediate space between the sheet stack S and the remaining stack H in the pulling of the carrying bars 7A, it is possible to omit the spacing bars 7B. Thereby, the changing process is accelerated, since the time needed for the pulling of the spacing bars 7B is saved.

The design of the device for pulling the remaining-stack bars 7 is in agreement with their special functions. The remaining-stack bars 7 are represented here as differently formed carrying bars 7A and spacing bars 7B, and they lie in the front carrying rail 9 and the rear carrying rail 10. The carrying bars 7A are longer and about twice as thick as the spacing bars 7B. All the remaining-stack bars 7 are provided with a drive connection. For this the remaining stack bars 7 are guided in common on the rear carrying rail 10, on which individual drives 50 are arranged. On the rear end of the frame 6 there can be provided a support rail 15, which is not firmly joined with the remaining-stack bars 7, but is movable both in common with these and also independently from them.

Figure 6:
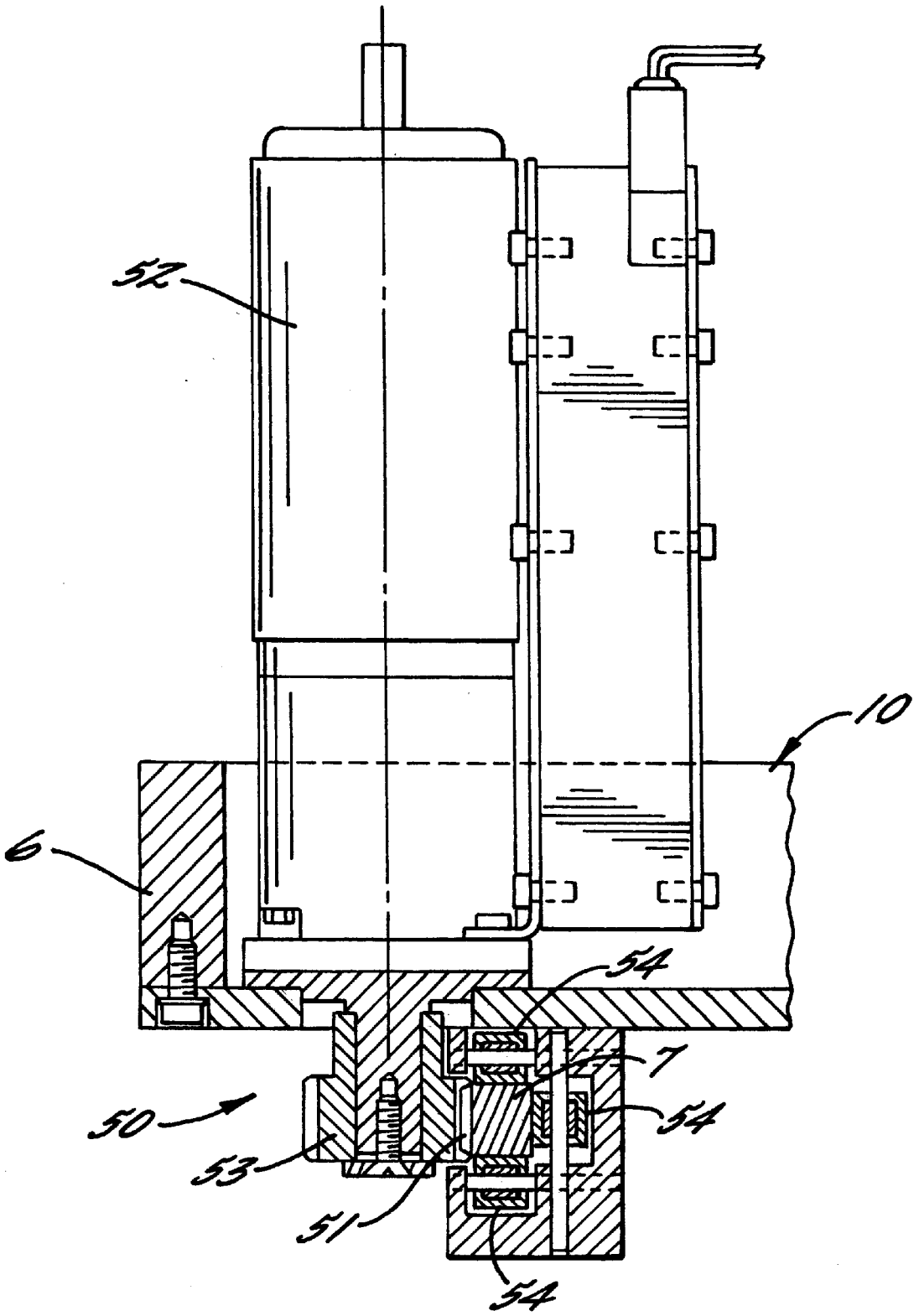
FIG. 6 is an enlarged view showing the drive mechanism for moving the remaining stack bars in accordance with the invention and FIG. 7 is an enlarged partial plan view of the drive mechanism.
Figure 7:
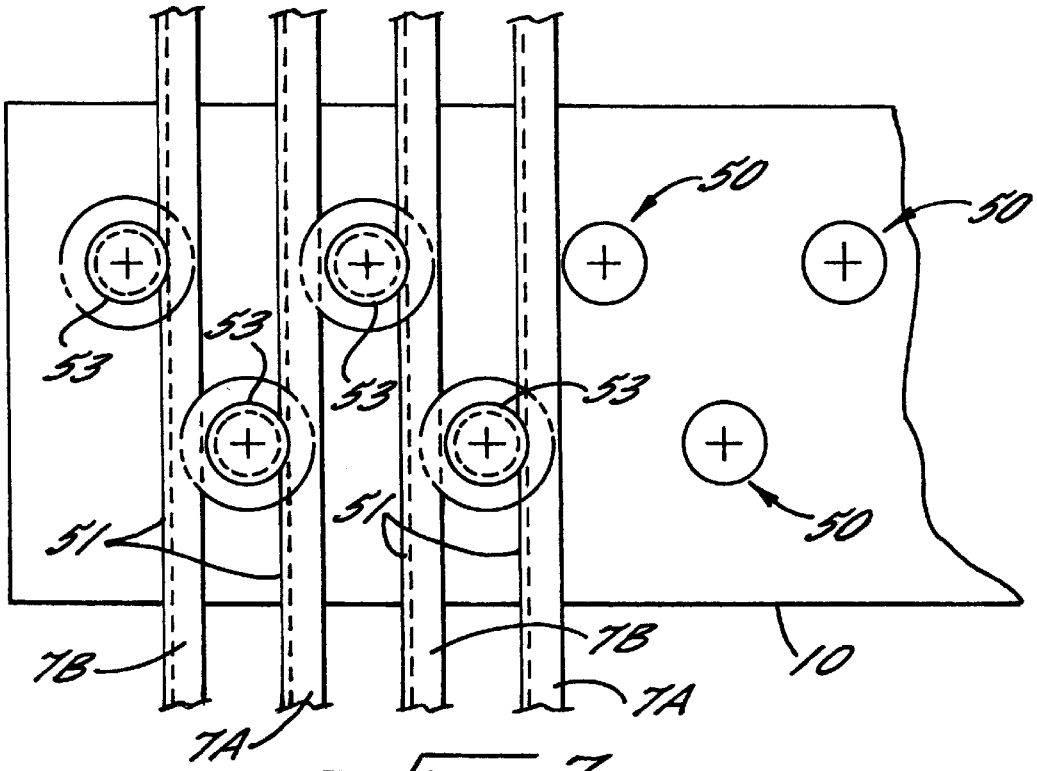

In FIGS. 6 and 7 there are represented the details for the individual drives 50 and their arrangement.

In order to shift the remaining-stack bars 7, these are moved by individual drives 50 over gears 51 in the direction toward the stacking zone. Gears 51 are formed laterally on every remaining-stack bar 7. In order to guarantee a precise functioning, the edges of the toothed side of a remaining-stack bar 7 are beveled. Thereby, the possibility that the gear 51 will have an unfavorable effect on the pallet P or, above all, act on sheets of the remaining-stack H or sheet stack S is avoided. This is also not the case in the stack unification.

For the sliding of all the remaining-stack bars 7 into the grooves of the pallet P, the remaining-stack bars are advanced asynchronously parallel by means of their individual drives 50. There it can be provided that the advance movement is guided by means of the individual drives 50 only up to a waiting position. The final thrusting-in movement to the thrust-in end position can then be executed over the rear carrying rail 10 by the drive 12 over the remaining path up to the front carrying bar 9. For this, the rear carrying rail 10 can be moved on guide rails 13 by a drive 12 (see also FIGS. 3 and 4). The drive 12 can be constructed as pressure-medium drive or as an electric motor drive.

An individual drive 50 is formed from a servo motor 52, a drive pinion 53 and a straight-line guidance of several guide rollers 54. The servo motor 52 is seated, in the illustrated embodiment, vertically on the rear carrying rail 10 and engages into the gearing 51 on the remaining-stack bar 7. For this purpose, the gear 51 is arranged laterally on each remaining-stack bar 7 and extends essentially over the entire length of the remaining-stack bar 7, so that this forms essentially a toothed rack. The lateral arrangement avoids effects of the gearing on the sheets and yields an improved guidance. Each remaining-stack bar 7, therefore, is guided on its upper and under side by several pairs of guide rollers 54.

Furthermore, each remaining-stack bar 7 is guided on its lengthwise sides, in the first place by the drive pinion 53 and on the oppositely lying side by further vertically framing guide rollers 54. Thereby, a tilt-free movement is possible which simultaneously requires the least possible amount of drive energy.

A respective controller is provided for each servo motor 52, which makes possible a differentiated influencing of the shifting movement of each individual remaining-stack bar 7 with respect to its speed, positioning and load as well as in the sliding into the grooves of the pallet P, and also in the pulling out of the stack zone between remaining-stack H and sheet stack S. In the control for the drive of an individual remaining-stack bar 7, a position monitoring and a monitoring for the pull load can be provided which is possible by means of electronic control means.

For the pulling of the remaining-stack bars 7, if need be, the support rail 15 is first driven back again into the starting position independently of the remaining-stack bars 7, by means of the drive 12. There the remaining-stack bars 7, at first, however, the carrying bars 7A, are clamped between remaining stack H and sheet stack S. Then the remaining-stack bars 7 are pulled out of the stacking zone by means of the individual drives 50. Here the model described further above can be used, in which the remaining-stack bars 7 are pulled out from the middle outward, in which at first only the carrying bars 7A and then the spacing bars 78 are pulled and/or as the speed of the remaining-stack bars 7 from the inside outward is varied, in order to achieve purposefully gentle but nevertheless optimized rapid stack unification. The pulling movement of each individual remaining-stack bar 7 occurs at a constant speed.

What is claimed is:

1. A device for changing a sheet stack in a sheet feeder of a sheet processing machine, the stack changing device comprising:

a stack lifting mechanism for raising and lowering of a sheet stack, a remaining-stack carrying device including remaining-stack bars for temporarily receiving a remaining stack and transferring said remaining stack to a newly fed-in sheet stack, and a respective drive mechanism associated with each of the remaining stack bars for slidably moving the respective remaining stack bar longitudinally into and out of the stack zone, each drive mechanism being operable and controllable independently from the other drive mechanisms.

2. The stack changing device according to claim 1 wherein each of the remaining-stack bars includes a respective toothed rack gearing.

3. The stack changing device according to claim 2 wherein each of the drive mechanisms comprises a servo motor which is operable over its corresponding remaining-stack bar toothed rack gearing through a respective drive pinion.

4. The stack changing device according to claim 3 wherein the remaining-stack bars are carried on a carrying rail and are guided in their longitudinal sliding movement by guides which are provided on three sides of each remaining-stack bar and on a fourth side by the corresponding drive pinion.

5. The stack changing device according to claim 4 wherein the tooted rack gearing on each of the remaining stack bars extends over substantially the entire length of a side of the respective remaining-stack bar and wherein the edges of the side of the respective remaining stack bars which include the toothed rack gearing are beveled.

6. The stack changing device according to claim 5 wherein the carrying rail is slidably mounted on the remaining-stack carrying device in parallel relation to direction in which the remaining-stack bars move.

7. The stack changing device according to claim 6 wherein the remaining-stack bars comprise carrying bars and spacing bars, each of the carrying bars having a thickness which is different than the thickness of the spacing bars.

* * * * *